US009353608B2

(12) United States Patent
Johannessen

(10) Patent No.: US 9,353,608 B2
(45) Date of Patent: May 31, 2016

(54) FLOW CONTROL DEVICE AND FLOW CONTROL METHOD

(75) Inventor: Kjetil Johannessen, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 832 days.

(21) Appl. No.: 13/635,607

(22) PCT Filed: Mar. 18, 2010

(86) PCT No.: PCT/NO2010/000104

§ 371 (c)(1), (2), (4) Date: Nov. 13, 2012

(87) PCT Pub. No.: WO2011/115494

PCT Pub. Date: Sep. 22, 2011

(65) Prior Publication Data

US 2013/0056221 A1 Mar. 7, 2013

(51) Int. Cl.

| | |
|---|---|
| ***E21B 43/12*** | (2006.01) |
| ***E21B 34/08*** | (2006.01) |
| ***E21B 33/12*** | (2006.01) |

(52) U.S. Cl.

CPC ..... *E21B 43/12* (2013.01); *E21B 33/1208* (2013.01); *E21B 34/08* (2013.01)

(58) Field of Classification Search

CPC ..... E21B 34/08; E21B 43/12

See application file for complete search history.

(56) References Cited

U.S. PATENT DOCUMENTS

| | | | | |
|---|---|---|---|---|
| 3,426,539 | A * | 2/1969 | Whear | 405/37 |
| 4,182,357 | A * | 1/1980 | Ornstein | 137/1 |
| 4,577,691 | A | 3/1986 | Huang et al. | |
| 4,821,801 | A | 4/1989 | Van Laar | |
| 4,858,691 | A | 8/1989 | Ilfrey et al. | |
| 5,273,066 | A | 12/1993 | Graham et al. | |
| 7,690,391 | B2 * | 4/2010 | Guest et al. | 137/67 |
| 8,820,414 | B2 * | 9/2014 | Mathiesen | E21B 34/08 166/332.1 |
| 2006/0175065 | A1 | 8/2006 | Ross | |
| 2007/0012434 | A1 | 1/2007 | Ringgenberg et al. | |
| 2007/0044962 | A1 | 3/2007 | Tibbles | |
| 2007/0246225 | A1 * | 10/2007 | Hailey | E21B 21/103 166/386 |
| 2008/0149323 | A1 | 6/2008 | O'Malley et al. | |

FOREIGN PATENT DOCUMENTS

| | | | |
|---|---|---|---|
| CA | 2 581 383 | A1 | 9/2008 |
| GB | 2169018 | A | 7/1986 |
| WO | WO 2008/004875 | A1 | 1/2008 |

OTHER PUBLICATIONS

World Oil, vol. 212, No. 11 (Nov. 1991), pp. 73-80.

* cited by examiner

*Primary Examiner* — David Andrews

(74) *Attorney, Agent, or Firm* — Birch, Stewart, Kolasch & Birch, LLP

(57) ABSTRACT

A method and apparatus is disclosed for controlling the flow of fluid in oil and/or gas production, involving a control device or an autonomous valve (2) operating by the Bernoulli principle and comprising a moveable disk or body (9) provided within a housing (4) for opening and closing said valve (2), involving use of a material (24) within the valve (2) that changes its properties as to shape and/or volume and/or elastic modulus when exposed to a chemical substance contained in the flow of fluid and thus altering said flow of fluid.

30 Claims, 7 Drawing Sheets

FLOW CONTROL DEVICE AND FLOW CONTROL METHOD

The present invention relates to a flow control device and a flow control method.

The present invention is based on a self adjusting or autonomous valve as disclosed in WO 2008/004875 A1 and operating by the Bernoulli principle, belonging to the applicant of the present invention.

Devices for recovering of oil and gas from long, horizontal and vertical wells are known from U.S. Pat. Nos. 4,821,801, 4,858,691, 4,577,691 and GB patent publication No. 2169018. These known devices comprise a perforated drainage pipe with, for example, a filter for control of sand around the pipe. A considerable disadvantage with the known devices for oil/and or gas production in highly permeable geological formations is that the pressure in the drainage pipe increases exponentially in the upstream direction as a result of the flow friction in the pipe. Because the differential pressure between the reservoir and the drainage pipe will decrease upstream as a result, the quantity of oil and/or gas flowing from the reservoir into the drainage pipe will decrease correspondingly. The total oil and/or gas produced by this means will therefore be low. With thin oil zones and highly permeable geological formations, there is further a high risk that of coning, i.e. flow of unwanted water or gas into the drainage pipe downstream, where the velocity of the oil flow from the reservoir to the pipe is the greatest.

From World Oil, vol. 212, N. 11 (November 1991), pages 73-80, is previously known to divide a drainage pipe into sections with one or more inflow restriction devices such as sliding sleeves or throttling devices. However, this reference is mainly dealing with the use of inflow control to limit the inflow rate for up hole zones and thereby avoid or reduce coning of water and or gas.

WO-A-9208875 describes a horizontal production pipe comprising a plurality of production sections connected by mixing chambers having a larger internal diameter than the production sections. The production sections comprise an external slotted liner which can be considered as performing a filtering action. However, the sequence of sections of different diameter creates flow turbulence and prevent the running of work-over tools.

When extracting oil and or gas from geological production formations, fluids of different qualities, i.e. oil, gas, water (and sand) is produced in different amounts and mixtures depending on the property or quality of the formation. None of the above-mentioned, known devices are able to distinguish between and control the inflow of oil, gas or water on the basis of their relative composition and/or quality.

With the autonomous valve as disclosed WO 2008/004875 A1 is provided an inflow control device which is self adjusting or autonomous and can easily be fitted in the wall of a production pipe and which therefore provide for the use of work-over tools. The device is designed to "distinguish" between the oil and/or gas and/or water and is able to control the flow or inflow of oil or gas, depending on which of these fluids such flow control is required.

The device as disclosed in WO 2008/004875 A1 is robust, can withstand large forces and high temperatures, prevents draw dawns (differential pressure), needs no energy supply, can withstand sand production, is reliable, but is still simple and very cheap.

The device or valve as disclosed in WO 2008/004875 A1 is possibly the best option today. Still there might be problems cutting off both water and gas in the same valve. It might also be a problem to cut off water in the case of low viscosity oil.

In addition the present invention could provide a slower or even permanent change in the characteristic of the device or valve as disclosed in WO 2008/004875 A1. Instability may be a potential problem with said device or valve due to the fast response of the body or disk and the long time constant to the inflow into the screens. Long time delays generally have potential for instability in regulation systems. With the prior art valve as disclosed in WO 2008/004875 A1 there is also a lack of possibility to permanently seal off a section of the well if only water is produced.

US 2008/149323 discloses a material sensitive downhole flow control device. US 2007/044962 discloses a system for isolating flow in a shunt tube, using a swellable material. US 2006/175065 discloses a water shut off method using a material that swells in the presence of a specific substance or substances.

Preferred embodiments of the invention are stated in the dependent claims.

The present invention will be further described in the following by means of examples and with reference to the drawings, where:

Figure 5:
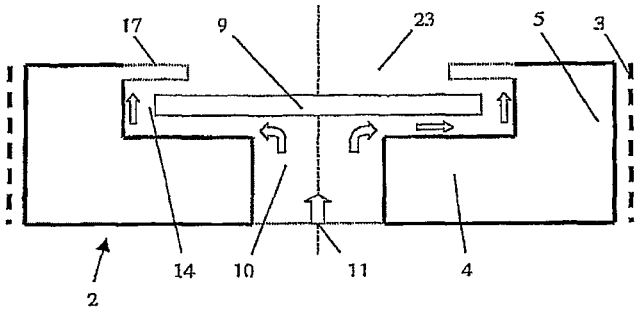
Prior Art Fig. 5
Figure 6:
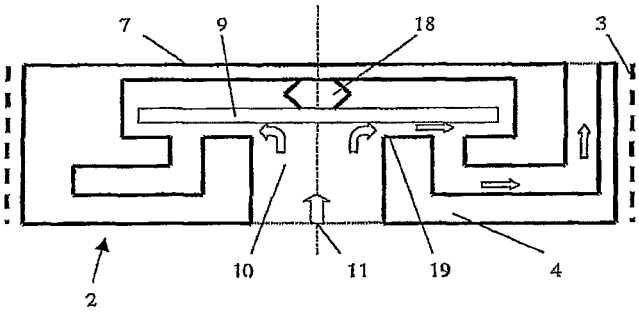
Prior Art Fig. 6
Figure 7:
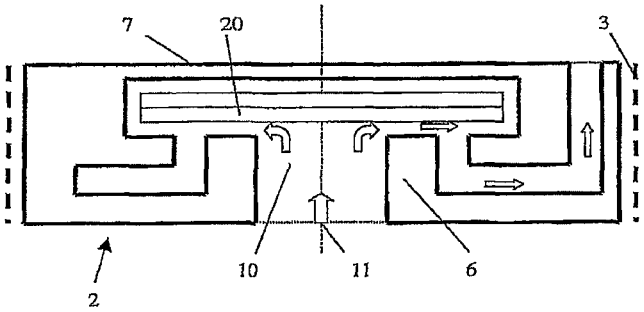
Prior Art Fig. 7
Figure 8:
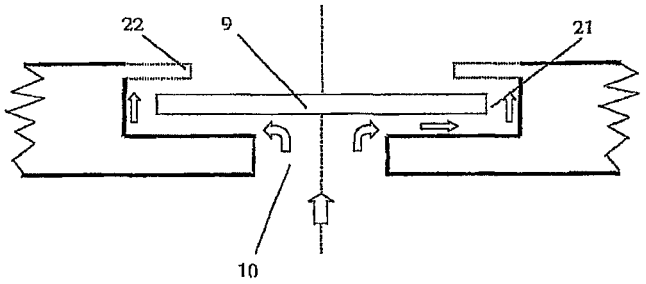
Prior Art Fig. 8
Figure 9:
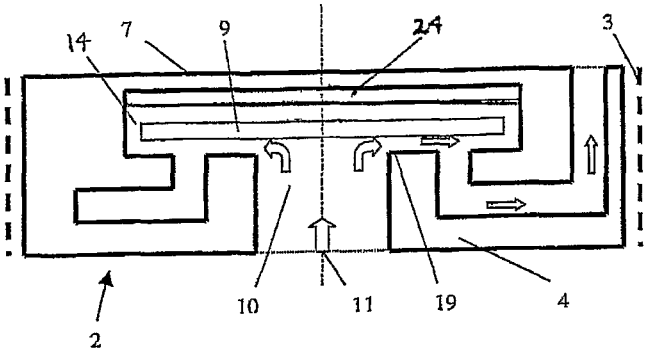
Figure 11:
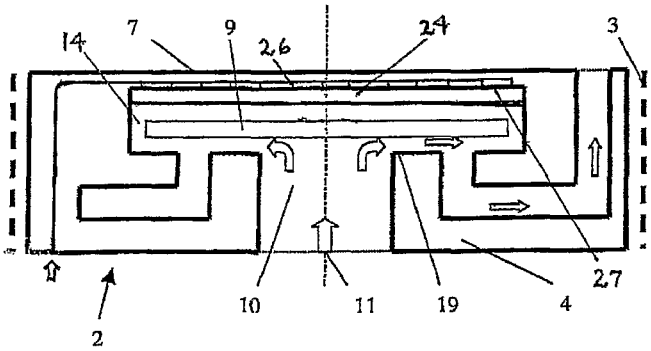
Figure 10:
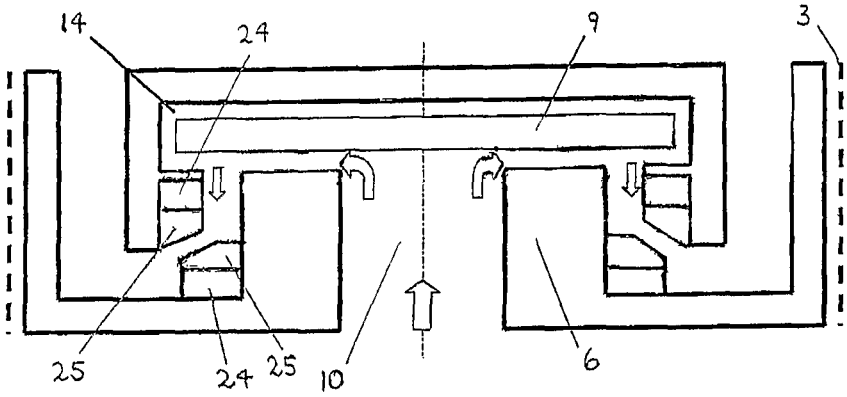

FIG. 5 shows a principal sketch of another embodiment of the control device according to WO 2008/004875 A1, FIG. 6 shows a principal sketch of a third embodiment of the control device according to WO 2008/004875 A1, FIG. 7 shows a principal sketch of a fourth embodiment of the control device according to WO 2008/004875 A1, FIG. 8 shows a principal sketch of a fifth embodiment of WO 2008/004875 A1 where the control device is an integral part of a flow arrangement, FIG. 9 shows a principal sketch of a first embodiment according to the present invention, where swelling backing material is provided in the open space for the moveable disc or body of the autonomous valve of WO 2008/004875 A1, FIG. 10 shows a principal sketch of a second embodiment according to the present invention, where swelling backing material is provided behind hard metal wedges oppositely arranged in the flow path exiting said open space, and FIG. 11 shows a modification of the first embodiment of the invention, where a plurality of small channels are provided in the housing of said valve for pressure and fluid communication between a rear side of the swelling material and the surroundings of the valve.

Figure 1:
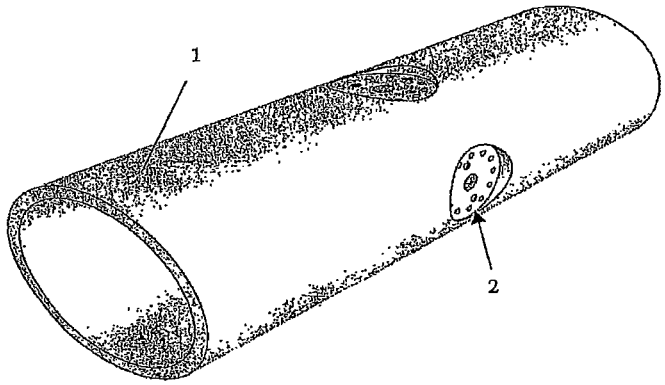
Prior Art Fig. 1
FIG. 1 shows a schematic view of a production pipe with a control device according to WO 2008/004875 A1, FIG. 2 *a*) shows, in larger scale, a cross section of the control device according to WO 2008/004875 A1, *b*) shows the same device in a top view.

FIG. 1 shows, as stated above, a section of a production pipe 1 in which a prototype of a control device 2 according to WO 2008/004875 A1 is provided. The control device 2 is preferably of circular, relatively flat shape and may be provided with external threads 3 (see FIG. 2) to be screwed into a circular hole with corresponding internal threads in the pipe or an injector. By controlling the thickness, the device 2, may be adapted to the thickness of the pipe or injector and fit within its outer and inner periphery.

Figure 2:
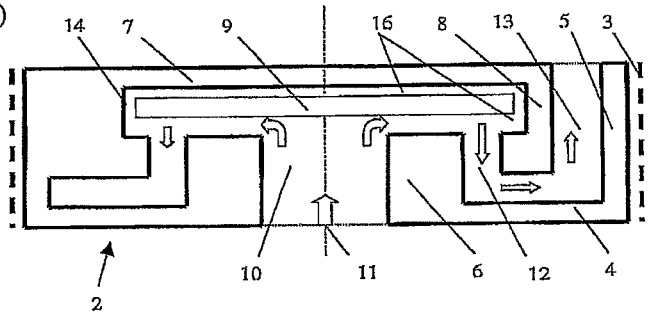
Prior Art Fig. 2 a)
Figure 2:
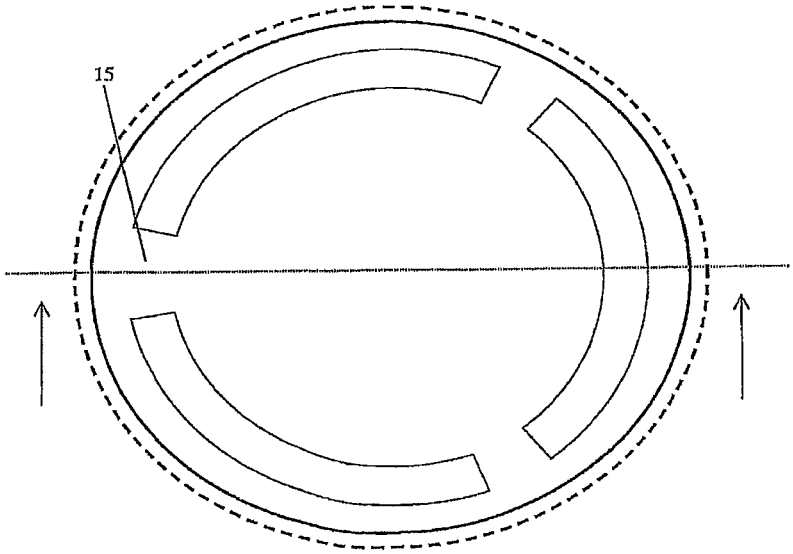
Prior Art Fig. 2 b)

FIG. 2 *a*) and *b*) shows the prior control device 2 of WO 2008/004875 A1 in larger scale. The device consists of a first disc-shaped housing body 4 with an outer cylindrical segment 5 and inner cylindrical segment 6 and with a central hole or aperture 10, and a second disc-shaped holder body 7 with an outer cylindrical segment 8, as well as a preferably flat disc or freely movable body 9 provided in an open space 14 formed between the first 4 and second 7 disc-shaped housing and holder bodies. The body 9 may for particular applications and adjustments depart from the flat shape and have a partly conical or semicircular shape (for instance towards the aperture 10.) As can be seen from the figure, the cylindrical segment 8 of the second disc-shaped holder body 7 fits within and protrudes in the opposite direction of the outer cylindrical segment 5 of the first disc-shaped housing body 4 thereby forming a flow path as shown by the arrows 11, where the fluid enters the control device through the central hole or aperture (inlet) 10 and flows towards and radially along the disc 9 before flowing through the annular opening 12 formed between the cylindrical segments 8 and 6 and further out through the annular opening 13 formed between the cylindrical segments 8 and 5. The two disc-shaped housing and holder bodies 4, 7 are attached to one another by a screw connection, welding or other means (not further shown in the figures) at a connection area 15 as shown in FIG. 2*b*).

The present invention exploits the effect of Bernoulli teaching that the sum of static pressure, dynamic pressure and friction is constant along a flow line:

$$p_{static} + \frac{1}{2}\rho v^2 + \Delta p_{friction}$$

When subjecting the disc 9 to a fluid flow, which is the case with the present invention, the pressure difference over the disc 9 can be expressed as follows:

$$\Delta p_{over} = \left[p_{over(P_4)} - p_{under(f(p_1, p_2, p_3))}\right] = \frac{1}{2}\rho v^2$$

Due to lower viscosity, a fluid such as gas will "make the turn later" and follow further along the disc towards its outer end (indicated by reference number 14). This makes a higher stagnation pressure in the area 16 at the end of the disc 9, which in turn makes a higher pressure over the disc. And the disc 9, which is freely movable within the space between the disc-shaped bodies 4, 7, will move downwards and thereby narrow the flow path between the disc 9 and inner cylindrical segment 6. Thus, the disc 9 moves down-wards or up-wards depending on the viscosity of the fluid flowing through, whereby this principle can be used to control (close/open) the flow of fluid through of the device.

Figure 3:
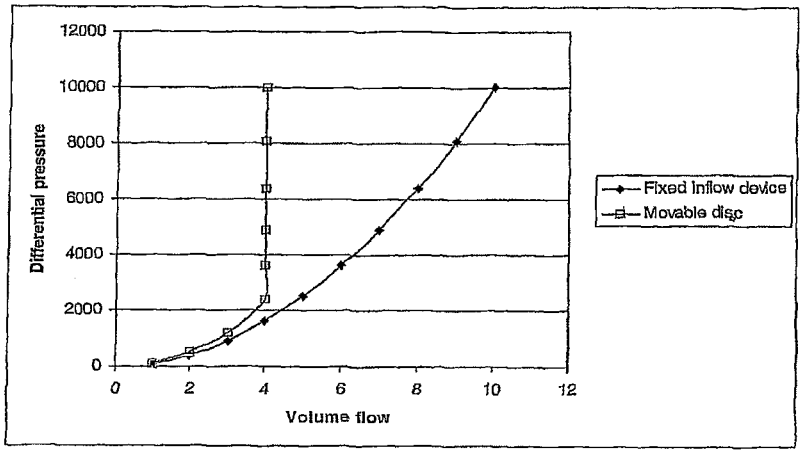
Prior Art Fig. 3
FIG. 3 is a diagram showing the flow volume through a control device according to WO 2008/004875 A1 vs. the differential pressure in comparison with a fixed inflow device.

Further, the pressure drop through a traditional inflow control device (ICD) with fixed geometry will be proportional to the dynamic pressure:

$$\Delta p = K \cdot \frac{1}{2}\rho v^2$$

where the constant, K is mainly a function of the geometry and less dependent on the Reynolds number. In the control device according to the present invention the flow area will decrease when the differential pressure increases, such that the volume flow through the control device will not, or nearly not, increase when the pressure drop increases. A comparison between a control device according to the present invention with movable disc and a control device with fixed flow-through opening is shown in FIG. 3, and as can be seen from the figure, the flow-through volume for the present invention is constant above a given differential pressure.

This represents a major advantage with the present invention as it can be used to ensure the same volume flowing through each section for the entire horizontal well, which is not possible with fixed inflow control devices.

Figure 4:
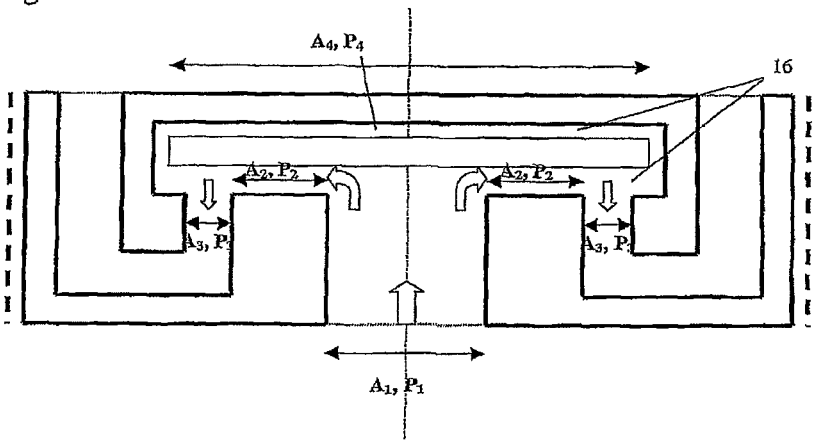
Prior Art Fig. 4
FIG. 4 shows the device shown in FIG. 2, but with the indication of different pressure zones influencing the design of the device for different applications.

When producing oil and gas the control device according to the invention may have two different applications: Using it as inflow control device to reduce inflow of water, or using it to reduce inflow of gas at gas break through situations. When designing the control device according to the invention for the different application such as water or gas, as mentioned above, the different areas and pressure zones, as shown in FIG. 4, will have impact on the efficiency and flow through properties of the device. Referring to FIG. 4, the different area/pressure zones may be divided into:

- $A_1$, $P_1$ is the inflow area and pressure respectively. The force ($P_1 \cdot A_1$) generated by this pressure will strive to open the control device (move the disc or body 9 upwards).
- $A_2$, $P_2$ is the area and pressure in the zone where the velocity will be largest and hence represents a dynamic pressure source. The resulting force of the dynamic pressure will strive to close the control device (move the disc or body 9 downwards as the flow velocity increases).
- $A_3$, $P_3$ is the area and pressure at the outlet. This should be the same as the well pressure (inlet pressure).
- $A_4$, $P_4$ is the area and pressure (stagnation pressure) behind the movable disc or body 9. The stagnation pressure, at position 16 (FIG. 2), creates the pressure and the force behind the body. This will strive to close the control device (move the body downwards).

Fluids with different viscosities will provide different forces in each zone depending on the design of these zones. In order to optimize the efficiency and flow through properties of the control device, the design of the areas will be different for different applications, e.g. gas/oil or oil/water flow. Hence, for each application the areas needs to be carefully balanced and optimally designed taking into account the properties and physical conditions (viscosity, temperature, pressure etc.) for each design situation.

FIG. 5 shows a principal sketch of another embodiment of the control device according to WO 2008/004875 A1, which is of a more simple design than the version shown in FIG. 2. The control device 2 consists, as with the version shown in FIG. 2, of a first disc-shaped housing body 4 with an outer cylindrical segment 5 and with a central hole or aperture 10, and a second disc-shaped holder body 17 attached to the segment 5 of the housing body 4, as well as a preferably flat disc 9 provided in an open space 14 formed between the first and second disc-shaped housing and holder bodies 4, 17. However, since the second disc-shaped holder body 17 is inwardly open (through a hole or holes 23, etc.) and is now only holding the disc in place, and since the cylindrical segment 5 is shorter with a different flow path than what is shown in FIG. 2, there is no build up of stagnation pressure ($P_4$) on the back side of the disc 9 as explained above in conjunction with FIG. 4. With this solution without stagnation pressure the building thickness for the device is lower and may withstand a larger amount of particles contained in the fluid.

FIG. 6 shows a third embodiment according to WO 2008/004875 A1 where the design is the same as with the example shown in FIG. 2, but where a spring element 18, in the form of a spiral or other suitable spring device, is provided on either side of the disc and connects the disc with the holder 7, 22, recess 21 or housing 4.

The spring element 18 is used to balance and control the inflow area between the disc 9 and the inlet 10, or rather the surrounding edge or seat 19 of the inlet 10. Thus, depending on the spring constant and thereby the spring force, the opening between the disc 9 and edge 19 will be larger or smaller, and with a suitable selected spring constant, depending on the inflow and pressure conditions at the selected place where the control device is provided, constant mass flow through the device may be obtained.

FIG. 7 shows a fourth embodiment according to WO 2008/004875 A1, where the design is the same as with the example in FIG. 6 above, but where the disc 9 is, on the side facing the inlet opening 10, provided with a thermally responsive device such as bi-metallic element 20.

When producing oil and/or gas the conditions may rapidly change from a situation where only or mostly oil is produced to a situation where only or mostly gas is produced (gas breakthrough or gas coning). With for instance a pressure drop of 16 bar from 100 bar the temperature drop would correspond to approximately 20° C. By providing the disc 9 with a thermally responsive element such as a bi-metallic element as shown in FIG. 7, the disc will bend upwards or be moved upwards by the element 20 abutting the holder shaped body 7 and thereby narrowing the opening between the disc and the inlet 10 or fully closing said inlet.

The above examples of a control device as shown in FIGS. 1 and 2 and 4-7 are all related to solutions where the control device as such is a separate unit or device to be provided in conjunction with a fluid flow situation or arrangement such as the wall of a production pipe in connection with the production of oil and gas. However, the control device may, as shown in FIG. 8, be an integral part of the fluid flow arrangement, whereby the movable body 9 may be provided in a recess 21 facing the outlet of an aperture or hole 10 of for instance a wall of a pipe 1 as shown in FIG. 1 instead of being provided in a separate housing body 4. Further, the movable body 9 may be held in place in the recess by means of a holder device such as inwardly protruding spikes, a circular ring 22 or the like being connected to the outer opening of the recess by means of screwing, welding or the like.

Embodiments of the present invention are shown in FIGS. 9-11, in which a material 24 is arranged within the device or autonomous valve 2 as described above, said material 24 changing its properties (volume and/or elastic modulus) under the presence of a given chemical substance or fluid, e.g. water.

More specifically FIGS. 9-11 show two different embodiments in which a swelling material 24 is respectively arranged in the open space 14 for the movable disc or body 9 (FIGS. 9 and 11) or is alternatively provided behind hard metal wedges 25 oppositely arranged in the flow path exiting said open space 14 (FIG. 10). In FIG. 11 there is shown a variant or development of the embodiment as shown in FIG. 9, and in which a plurality of small channels 26 provides pressure and fluid communication between a rear or attachment side 27 of the swelling material 24 and the surroundings of the valve 2. One reason with said fluid and pressure communication is that the swelling backing material 24 might need backing pressure in case of a large pressure differential and/or a long travel. Another reason is that the swelling rate will possibly increase if the swelling material 24 is exposed to said chemical substance (e.g. water) also from the rear side 27.

The main inventive idea is thus to use a material that changes it properties (volume and/or elastic modulus) under the presence of a given chemical substance. The material should be integrated in the valve or control device 2 to modify the inflow characteristics over time that the viscosity discrimination might not work very well for, in particular the presence of water.

The shut off mechanism can thus be based on two principles:

- Modifying the backing of the disc or body 9 so that e.g. a maximum opening is reduced under the influence of water (cfr. FIGS. 9 and 11).
- Modify the flow characteristics at a pressure reference location (cfr. FIG. 10).

There is a material that changes property in a sheltered area of the valve or control device 2. The simplest example is a polymer that swells under the influence of water. Such polymers can e.g. double their volume when exposed to water. The process takes time as the water needs to diffuse into the polymer. The increased volume behind the disc or body 9 expels flow from the flow channel and hence modifies the valve or control device 2. In the case of much water the swelling backing material 24 can fill the complete space behind the disc or body 9 and hence permanently nearly block the valve 2.

In the second principle, by introducing said oppositely arranged wedges 25, the edge geometry and hence the reference pressure transmitted to the open space or cavity 14 behind the disc or body 9 is modified. In principle this can also be a jaw (not shown) that cuts off flow. It should be noted that the second principle can be configured to reverse the effect of the valve or control device 2 leaving the edge area the high velocity area which might be advantageous for specific applications.

Some important characteristics are as follows:

- Possibility to shut off both on basis of viscosity and chemical composition.
- Potential for slow varying shut off in addition to rapid reaction as in WO 2008/004875 A1. (Stability).
- The use of a material 14 that changes shape, volume or elastic property under a chemical influence to alter the geometry of the control device or valve 2.
- Changing the flow velocity over or adjacent to the body or disc 9 and hence the Bernoulli force based on chemical sensitivity.
- The possibility to completely cut off the production by choking the complete channel that is the origin of the Bernoulli effect.
- The mechanism for this altering need not be coupled to the viscosity and hence separate choking criteria can be built into the control device or valve 2 e.g. both low viscosity and water (using a material that swells under the presence of water and not in the presence of hydrocarbons).
- Potential for chemical selectivity (it is possible that a backing material might be made sensitive e.g. to ions in the formation water).
- Modifying maximum channel dimensions available for the flow (without exposing the backing material 24 to high velocity flow and erosion.
- It is believed that the control device or valve 2 with this modification will be even more selective and utilize the best of two otherwise competing technologies in a compact unit not substantially more complicated than the valve 2 without said modification.

Examples of materials that swell in water, but that are little affected by hydrocarbons, are polymers based on e.g. Vinyl alcohol or acrylamid. The more polar, the higher the affinity to water. One example that is highly absorbing or swelling is Sodium polyacrylate. The affinity to water can be tailored to a large extent with the cross-linking. The principles are described in U.S. Pat. No. 3,220,960 (Cross-linked Hydrophilic Polymers and articles made there from). The amount of swelling and the mechanical properties can to a large extent be tailored by the degree of cross-linking.

In addition a further selectivity can be obtained following along the lines of e.g. U.S. Pat. No. 4,591,441 (Method and apparatus for separating oil from water) where a hydrogel is used to have an oil resisting/repelling function.

For higher temperatures and pressures, micro porous materials such as Zeolites (in the extreme in the form of molecular sieves) can be tailored to react with water or potentially water and methane. Generally the volume changes are relatively small, but can exert a considerable force.

Most or all such material systems are in principle reversible. However, the amount of water that is required to induce swelling and how low the amount will have to be for the material to go back to its original shape will vary and many such materials will be too sensitive to water. On the other hand, the application will produce a pressure typically counteracting the swelling mechanically attempting to drain the material and hence counteracting the naturally occurring swelling.

Reference is made to the paper entitled "Swellable Technology Systems Provide A Simple Zonal Isolation Method In The North Sea" by Alf Kolbjørn Sevre and Sverre Anderssen, available from http://bergen.spe.no/publish files/3.3 Easywell S.Andressen.pdf. Typical packers swell permanently in oil, but swelling in water is often reversible. The paper also illustrates another interesting effect that can be utilized; swelling in water can be governed by salinity. For example, the material can change when there is an influx of salty reservoir water. See also U.S. Provisional Patent Application No. 60/976,575 filed Oct. 1, 2007.

Rubber generally swells in oil or under the presence of hydrocarbons. Silicones are good examples of materials that are not influenced by water, but swells considerably with most hydrocarbons.

A large selection of materials for non reversible applications is referenced in WO 2006/003112.

A good example of a reversible swelling material system under contact with oil is: Methyl terminated, and silica and iron oxide filled, dimethyl polysiloxane, which is commercially distributed under the name of Red Silicone Rubber and is produced commercially by companies such as General Electric Company through its GE Silicone division. Reference is also made to U.S. Pat. No. 5,378,889 (Method and apparatus for detecting hydrocarbon fuels in a vapor state with an absorber-expander member).

The reader is referred to the following documents for further examples of the types of material that can be used in an embodiment of the present invention: JP 05123066, EP 1752690 A1, DE 35 39 595 A1, DE 42 11 302 A1, U.S. Pat. No. 6,358,580 B1, EP 0486869 B1, JP 10101850, U.S. Pat. No. 4,532,298, WO 2006/108784 A1 and U.S. Pat. No. 7,228,915 B2

Hence it has been demonstrated that a number of material systems can react reversibly and non reversibly to contact with:

Water

Salinity of different concentrations (water based solution)

Hydrocarbons

A material with an appropriate property can be engineered and tailored to perform a particular function for a particular application, for a limited range in composition, temperature and pressure.

The main function in the above embodiments is to alter the flow geometry and hence either:

Modify the fluid velocity in the area and hence modify the pressure acting on different parts of the floating member, or By other forces blocking or cutting off the flow thus overriding the pressure balancing principle of the floating member.

Referring to FIG. 10, the swelling material can be configured to either open up or close the exit area by modifying $P_3$ or $A_3$ (see FIG. 4). This will modify the balancing forces and can support or oppose the principal operation of the Bernoulli device to react to specific phases not only to viscosity. Alternatively the material can pinch of the area $A_3$ and thus induce a dominant pressure drop over this section of the device thence overriding the Bernoulli principle completely.

Referring to FIGS. 9 and 11, the backing/swelling material will normally be deformable. When it starts to swell it will hence effectively add to the pressure $P_4$ and also reduce the maximum movement of the floating member; this will not allow the situation where there is a maximum opening and hence a minimum drop in $P_2$. In the balancing equation it will contribute to an effective increase in pressure $P_4$ and a reduction in pressure $P_2$, forcing the floating member to increase pressure drop over the device. Eventually the swelling of the backing material can be made so substantial that the floating member pinches off all flow past the area $A_2$. In this situation a fluid exchange can be introduced to keep the pinching of permanent (if wanted) particularly with water that does no cause a permanent swelling in many situations.

For each different use case, a detailed engineering consideration is required of the balancing forces involved for a given set of viscosities and chemical property of the phases.

It will be appreciated that the material 24 may also be provided behind the disc 9 in FIG. 10, for example as shown in FIGS. 9 and 11, i.e. arranged in or adjacent the open space 14 within which the disc 9 is provided.

The present invention is only restricted by the appended claims, and not by the embodiments as described above. In the context of the present invention the term "oil and/or gas production" includes any process related to exploration or exploitation of oil and/or gas (e.g. installation, injection of steam, etc.) and is thus not restricted to a production mode.

The invention claimed is:

1. A flow control device for controlling fluid flow of an oil and/or gas reservoir, the device comprising a movable body provided within a housing having an open space, the movable body being arranged to adjust the flow of fluid through the control device autonomously by exploiting the Bernoulli principle, and further comprising a material arranged to be exposed to the fluid flowing through the control device, and the material being adapted to change its shape and/or volume and/or elastic modulus on exposure to a chemical substance contained in the fluid, such changes affecting Bernoulli-related forces acting on the movable body and thereby affecting the flow of fluid through the control device, wherein the movable body and the material are separate and the movable body is arranged to be freely movable within the open space.

2. The flow control device as claimed in claim 1, wherein the body is arranged to face an aperture provided in the housing, such that the fluid enters the control device through the aperture, flowing towards and along the body and then out of the control device.

3. The flow control device as claimed in claim 1, wherein the material is a swelling material.

4. The flow control device as claimed in claim 1, wherein the material is arranged in or adjacent the open space within which the movable body is provided.

5. The flow control device as claimed in claim 1, wherein the material is arranged to form and/or move at least one flow restriction and/or altering element.

6. The flow control device as claimed in claim 5, wherein the material is provided behind wedges, which are oppositely arranged in a flow path, for cooperatively and variably restricting said flow path.

7. The flow control device as claimed in claim 1, wherein a plurality of pressure and fluid communication channels are provided at a rear side of the material.

8. The flow control device as claimed claim 1, wherein the chemical substance comprises at least one of: water, salt and hydrocarbon.

9. The flow control device as claimed in claim 1, wherein the material is a reversible swelling material.

10. The flow control device as claimed in claim 1, wherein the movable body is arranged to adjust the flow of fluid through the control device autonomously by exploiting the Bernoulli principle when the material has been exposed to the chemical substance.

11. A method of controlling the flow of fluid from an oil and/or gas reservoir into a production pipe positioned within the reservoir, comprising providing the pipe with a flow control device as claimed in claim 1, and operating the flow control device according to a method comprising altering Bernoulli-related forces acting on the movable body, and thereby altering the flow of fluid through the control device, using a material arranged to be exposed to the fluid flowing through the control device, the material being adapted to change its shape and/or volume and/or elastic modulus on exposure to a chemical substance contained in the fluid.

12. A method of operating a flow control device to control fluid flow of an oil and/or gas reservoir, the flow control device comprising a movable body provided within a housing having an open space, the moveable body arranged to adjust the flow of fluid through the control device autonomously by exploiting the Bernoulli principle, the method comprising the steps of altering Bernoulli-related forces acting on the movable body, and thereby altering the flow of fluid through the control device, using a material arranged to be exposed to the fluid flowing through the control device, the material being adapted to change its shape and/or volume and/or elastic modulus on exposure to a chemical substance contained in the fluid, wherein the movable body and the material are separate and the movable body is freely movable within the open space.

13. The method as claimed as claimed in claim 12, wherein the chemical substance comprises at least one of: water, salt and hydrocarbon.

14. The method as claimed in claim 12, wherein the movable body adjusts the flow of fluid through the control device autonomously by exploiting the Bernoulli principle when the material has been exposed to the chemical substance.

15. A method for controlling the flow of fluid in oil and/or gas production, comprising the steps of involving a control device or an autonomous valve operating by the Bernoulli principle and including a moveable disk or body provided within a housing for opening and closing said valve, the housing comprising an open space, the method involving use of a material within the valve that changes its properties as to shape and/or volume and/or elastic modulus when exposed to a chemical substance contained in the flow of fluid and thus altering said flow of fluid, wherein the material and the movable disk or body are separate and the movable body is freely movable within the open space.

16. The method as claimed in claim 15, wherein the material is used to alter Bernoulli-related forces acting on the movable disk or body, and thereby to alter the flow of fluid through the control device.

17. The method in accordance with claim 15, further comprising the step of using a swelling material.

18. The method in accordance with claim 17, further comprising the step of using a reversible swelling material.

19. The method in accordance with claim 15, further comprising the step of said material substantially completely blocking or shutting off the flow of fluid through the valve.

20. The method in accordance with claim 15, further comprising the step of said chemical substance being water.

21. The method in accordance with claim 15, further comprising the step of modifying flow characteristics at a pressure reference location within said valve.

22. The method in accordance with claim 15, further comprising the step of changing the flow velocity over or adjacent to the body or disk and hence the Bernoulli force based on chemical sensitivity.

23. The method in accordance with claim 15, further comprising the step of providing pressure and fluid communication between a rear side of the material and the surroundings of the valve.

24. An apparatus for controlling the flow of fluid in oil and/or gas production, comprising a control device or an autonomous valve operating by the Bernoulli principle and comprising a moveable disk or body provided within a housing for opening and closing the valve, the housing comprising an open space, the apparatus further comprising a material arranged within said valve having shape and/or volume and/or elastic modulus changing properties by exposure to a chemical substance contained in the flow of fluid, wherein the material and the movable disk or body are separate and the movable body is arranged to be freely movable within the open space.

25. The apparatus in accordance with claim 24, wherein the material is arranged such that such changes to its shape and/or volume and/or elastic modulus alter Bernoulli-related forces acting on the movable disk or body and thereby alter the flow of fluid through the control device.

26. The apparatus in accordance with claim 24, wherein said housing comprising a recess or housing body, said movable disk or body faces the outlet of an aperture or hole in the center of the recess or housing body and is held in place in the recess or housing body by means of a holder arrangement, thereby forming a flow path where the fluid enters the valve through the central aperture or inlet flowing towards and along the body and out of the recess or housing.

27. The apparatus in accordance with claim 24, wherein said material is a reversible swelling material.

28. The apparatus in accordance with claim 24, wherein said material is arranged in the open space within which the moveable disk or body is provided.

29. The apparatus in accordance with any claim 24, wherein said material is provided behind hard metal wedges which are oppositely arranged in the flow path, for cooperatively and variably restricting said flow path.

30. The apparatus in accordance with claim 24, wherein a plurality of pressure and fluid communication channels are provided between a rear side of the material and the surroundings of the valve.

* * * * *